US009343021B2

(12) United States Patent
Li et al.

(10) Patent No.: US 9,343,021 B2
(45) Date of Patent: May 17, 2016

(54) DISPLAY DEVICE FOR MITIGATING THE OCCURRENCE OF UNDESIRABLE BRIGHT LINES IN AN IMAGE AND A DRIVING METHOD THEREOF

(71) Applicant: BOE TECHNOLOGY GROUP CO., LTD., Beijing (CN)

(72) Inventors: Shou Li, Beijing (CN); Chulgyu Jung, Beijing (CN); Yuxin Bi, Beijing (CN); Jianing Lu, Beijing (CN)

(73) Assignee: BOE TECNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 14/526,437

(22) Filed: Oct. 28, 2014

(65) Prior Publication Data

US 2015/0348474 A1 Dec. 3, 2015

(30) Foreign Application Priority Data

May 28, 2014 (CN) ..... 2014 1 0231905

(51) Int. Cl.
*G09G 3/36* (2006.01)

(52) U.S. Cl.
CPC ..... *G09G 3/36* (2013.01); *G09G 2310/0272* (2013.01); *G09G 2320/02* (2013.01)

(58) Field of Classification Search
CPC ..... G09G 3/34; G09G 3/3406; G09G 3/342; G09G 3/3426; G09G 3/36; G09G 2310/0272; G09G 2320/02; G09G 2320/0233; G09G 2320/0257; G09G 2320/0266
See application file for complete search history.

(56) References Cited

U.S. PATENT DOCUMENTS 6,933,918 B1 * 8/2005 Park ..... G09G 3/342 345/102
2007/0091059 A1 * 4/2007 Kang ..... G09G 3/342 345/102

(Continued)

FOREIGN PATENT DOCUMENTS

CN 2768037 3/2006
CN 101114426 1/2008

(Continued)

OTHER PUBLICATIONS

Chinese Office Action with English Language Translation, dated Sep. 8, 2015, Chinese Application No. 201410231905X.

(Continued)

*Primary Examiner* — Nathan Danielsen
(74) *Attorney, Agent, or Firm* — Blakely Sokoloff Taylor & Zafman LLP

(57) ABSTRACT

The embodiments of the present invention provide a display device and a driving method thereof, which relates the display technology and can avoid occurrence of bad bright line of the image and improve display quality of the image. The display device may comprise a display panel and a backlight module disposed below the display panel, the display panel may comprise at least one display area, the display area may comprise at least one sub display area, the backlight module may comprise at least one light emitting unit, the light emitting units are in one-to-one correspondence with the sub display areas. Each sub display area may comprise at least one row of pixel units, the pixel units may comprise switch elements. When the switch elements of the first row of pixel units in a sub display area are turned on, the light emitting unit in the backlight module corresponding to the sub display area is in a turn-on state, when the switch elements in the last row of pixel units in a sub display area are turned off, the light emitting unit in the backlight module corresponding to the sub display area is in a turn-off state. The embodiments of the present invention may be applied to the manufacture of the display device.

7 Claims, 5 Drawing Sheets

(56) References Cited

U.S. PATENT DOCUMENTS

| | | | | |
|---|---|---|---|---|
| 2009/0066687 | A1* | 3/2009 | Oke | G09G 3/342 345/214 |
| 2009/0231365 | A1* | 9/2009 | Yin | G09G 3/3406 345/690 |
| 2010/0177085 | A1* | 7/2010 | Yamagishi | G09G 3/36 345/211 |
| 2011/0050760 | A1 | 3/2011 | Ito et al. | |
| 2012/0001953 | A1* | 1/2012 | Hirakata | G09G 3/2025 345/690 |

FOREIGN PATENT DOCUMENTS

| | | |
|---|---|---|
| CN | 101533617 | 9/2009 |
| CN | 102737602 | 10/2012 |
| KR | 1020070045045 | 5/2007 |

OTHER PUBLICATIONS

Chinese Office Action with English Language Translation, dated Feb. 22, 2016, Chinese Application No. 201410231905.X.

* cited by examiner

DISPLAY DEVICE FOR MITIGATING THE OCCURRENCE OF UNDESIRABLE BRIGHT LINES IN AN IMAGE AND A DRIVING METHOD THEREOF

RELATED APPLICATIONS

The present application claims the benefit of Chinese Patent Application No. 201410231905.X, filed May 28, 2014, the entire disclosure of which is incorporated herein by reference.

FIELD OF THE INVENTION

This disclosure relates to the display technology, particularly to a display device and a driving method thereof.

BACKGROUND OF THE INVENTION

In manufacture of the liquid crystal display device, in order to enable the liquid crystal panel to have the characteristics of better image quality and low power consumption, the current light emitting diode (LED) backlight driving signal is always in synchronization with the data line signal, which solves the problem of image quality and power consumption perfectly.

However, with the development of the technology, the liquid crystal display device develops towards the direction of large size and high resolution. The ultra high definition (UHD) television of 110 inches has been published in the last year. At present, as for the control of a display device in a large size, the backlight driving signal is always in synchronization with the data line signal, in this manner however, when the scanning of a frame just starts after the scanning of a previous frame is finished, a bright line may appear in the last row of the previous frame scanning, which may result in abnormity of the image and influence the image quality greatly.

SUMMARY OF THE INVENTION

The embodiments of the present invention provide a display device and a driving method thereof, which can mitigate or avoid occurrence of bad bright line of the image and improve display quality of the image.

The embodiments of the present invention adopt the following technical solutions.

On the one hand, a display device is provided. The display device may comprise a display panel and a backlight module disposed below the display panel. The display panel may comprise at least one display area including at least one sub display area. The backlight module may comprise at least one light emitting unit which may be in one-to-one correspondence with the sub display area. Each sub display area may comprise at least one row of pixel units including switch elements. When the switch elements of the first row of pixel units in the sub display area are turned on, the light emitting unit in the backlight module corresponding to the sub display area is in a turn-on state, when the switch elements in the last row of pixel units in the sub display area are turned off, the light emitting unit in the backlight module corresponding to the sub display area is in a turn-off state.

In another embodiment, the display device may further comprise gate driving circuits in one-to-one correspondence with each display area, the gate driving circuits control the switch elements of the pixel units in the display area to be turned on row by row by means of scanning signals.

Further, the scanning directions of the scanning signals of the gate driving circuits may be same.

In an embodiment, the number of the at least one display area of the display device may be four, the number of the gate driving circuits may be four.

Further, the display device may further comprise two data driving circuits, the four display areas of the display panel may constitute two image areas, wherein each image area may be driven by one of the data driving circuits.

Further, the backlight module may comprise a backlight driving module for generating a backlight driving signal and outputting the backlight driving signal to the light emitting unit, so as to turn on or off the light emitting unit based on the backlight driving signal.

Further, the back light driving module may comprise a signal acquisition sub module and a driving sub module, wherein the signal acquisition sub module may be used for acquiring the scanning signals of the gate driving circuits, the driving sub module may be used for generating the backlight driving signal based on the scanning signals of the gate driving circuits.

On the other hand, a driving method of a display device is provided. The display device may comprise a display panel and a backlight module disposed below the display panel. The display panel may comprise at least one display area including at least one sub display area; the backlight module may comprise at least one light emitting unit which may be in one-to-one correspondence with the sub display areas. Each sub display area may comprise at least one row of pixel units including switch elements. The driving method may comprise:

controlling the light emitting unit in the backlight module corresponding to a sub display area to be a turn-on state when the switch elements of the first row of pixel units in the sub display area are turned on;

controlling the light emitting unit in the backlight module corresponding to the sub display area to be a turn-off state when the switch elements in the last row of pixel units in the sub display area are turned off.

Further, the driving method may further comprise: controlling the switch elements of the pixel units in the display area to be turned on row by row by means of scanning signals.

In another embodiment, the display device may comprise four gate driving circuits, the number of the at least one display area may be four, the driving method may further comprise: providing a scanning signal to one of the four display areas by each of the four gate driving circuits in one-to-one correspondence with the four display areas respectively.

Further, the scanning directions of the scanning signals outputted by the four gate driving circuits may be same.

Further, the driving method may further comprise:

generating a backlight driving signal;

outputting the backlight driving signal to the light emitting unit so as to turn on or off the light emitting unit based on the backlight driving signal.

Further, the step of generating a backlight driving signal may comprise:

acquiring the scanning signal, and generating the backlight driving signal based on the scanning signal.

The display device and the driving method thereof provided by the embodiments of the present invention can realize that when the switch elements in the last row of pixel units in a sub display area of the display panel are turned off, the light emitting unit in the backlight module corresponding to the sub display area is in a turn-off state, thereby avoiding the occurrence of bad bright line of the image and improving display quality of the image.

BRIEF DESCRIPTION OF THE DRAWINGS

In order to explain the technical solutions of the embodiments of the present invention more clearly, the drawings to be used in the description of the embodiments will be introduced briefly in the following. Apparently, the drawings described below are only part of the embodiments of the present invention, the ordinary skilled person in the art can also obtain other embodiments based on these drawings without making any inventive effort.

REFERENCE SIGNS

1: display panel;
11: display area;
111: sub display area;
12-1, 12-2, 12-3, 12-4: gate driving circuit;
2: backlight module;
21: light emitting unit;
22: backlight driving module;
221: signal acquisition sub module;
222: driving sub module.

DETAILED DESCRIPTION OF THE INVENTION

Next, the technical solutions of the embodiments of the present invention will be described clearly and completely in conjunction with the drawings of the embodiments of the present invention. Apparently, the embodiments described are only part rather than all of the embodiments of the present invention. Based on the embodiments of the present invention, all the other embodiments obtained by the ordinary skilled person in the art without making any inventive effort belong to the scope claimed by the present invention.

Figure 1:
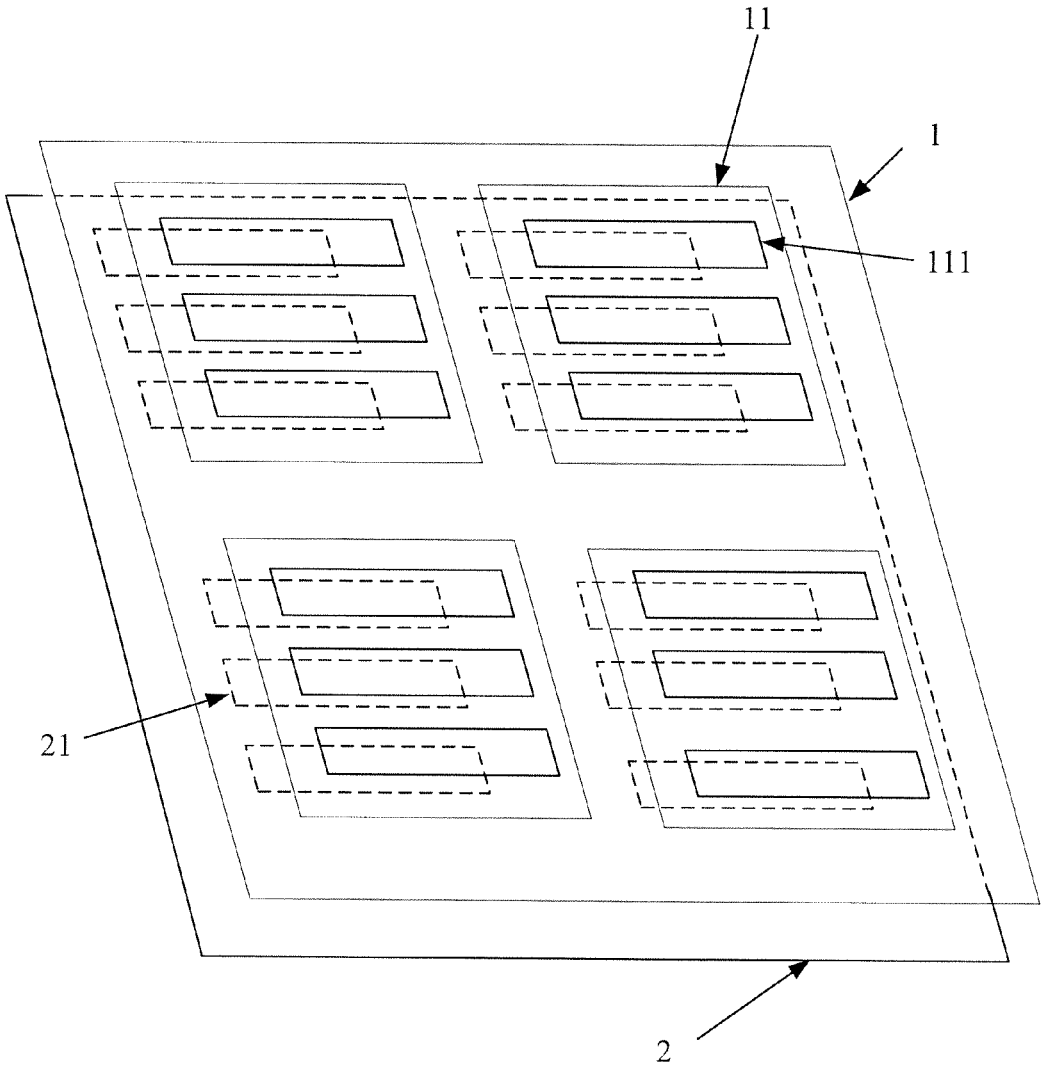
FIG. 1 is a structural schematic view of a display device provided by an embodiment of the present invention.

One embodiment of the present invention provides a display device, which display device may be a display device such as an electronic paper, a mobile phone, a television, a digital photo frame, etc. As shown in FIG. 1, the display device may comprise a display panel 1 and a backlight module 2 disposed below the display panel 1. The display panel 1 may comprise at least one display area 11, the display area 11 may comprise at least one sub display area 111. The backlight module 2 may comprise at least one light emitting unit 21, the light emitting units 21 may be in one-to-one correspondence with the sub display areas 111. Each sub display area 111 may comprise at least one row of pixel units, the pixel units may comprise switch elements.

When the switch elements of the first row of pixel units in the sub display area 111 are turned on, the light emitting unit 21 in the backlight module 2 corresponding to the sub display area 111 is in a turn-on state; when the switch elements of the last row of pixel units in the sub display area 111 are turned off, the light emitting unit 21 in the backlight module 2 corresponding to the sub display area 111 is in a turn-off state.

In FIG. 1, single lamp strips are used as the light emitting units 21 illustratively. As shown in FIG. 1, each lamp strip 21 corresponds to a sub display area 111. Certainly, the light emitting unit 21 may also be a dot matrix light source, a direct type back light source or other types of light sources that can form a predetermined light emitting area, which will not be defined specifically here.

Figure 2:
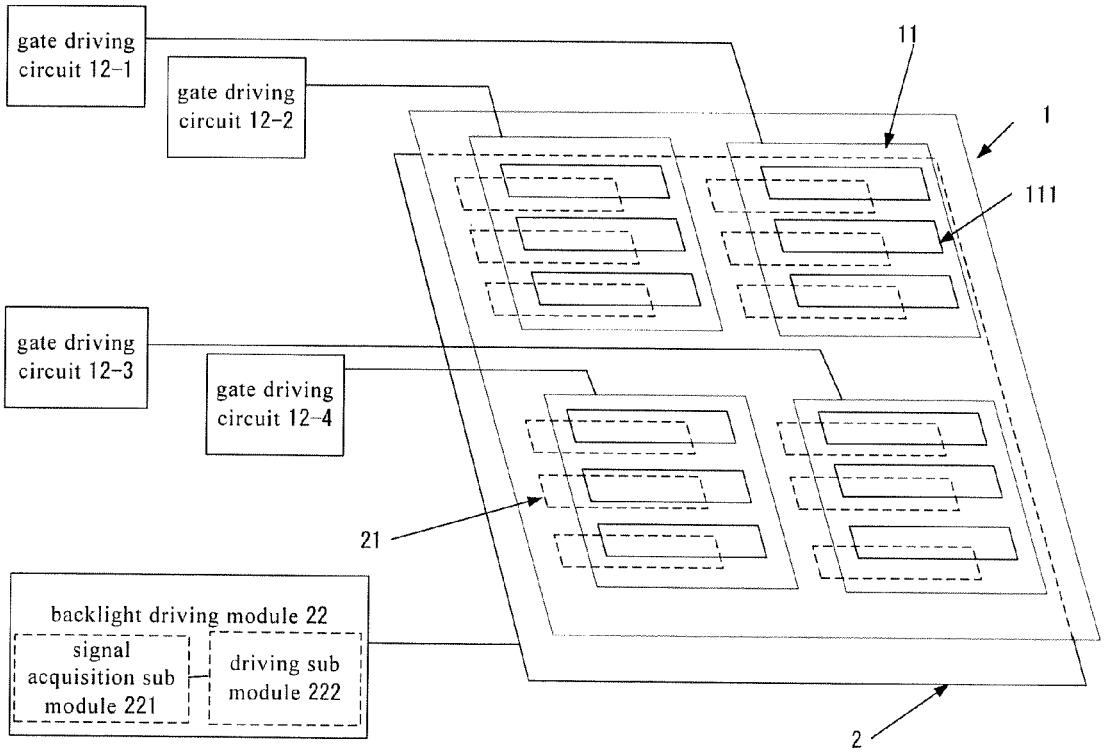
FIG. 2 is a structural schematic view of a display device provided by another embodiment of the present invention.

Referring to FIG. 2, the display device may further comprise gate driving circuits 12-1, 12-2, 12-3, 12-4 in one-to-one correspondence with each display area 11, the gate driving circuits 12-1, 12-2, 12-3, 12-4 may control the switch elements of the pixel units in the display area 11 to be turned on row by row by means of scanning signals. Further, the scanning directions of the scanning signals of respective gate driving circuits 12-1, 12-2, 12-3, 12-4 may be same, that is, in the respective display areas 11 of the display panel 1 as shown in FIG. 2, taking the orientation in FIG. 2 for example, the scanning directions of the scanning signals in each display area 11 may be same, i.e., the manner of scanning from top to bottom or from bottom to top may be used. It can be understood that when the manner of scanning from top to bottom is used, the uppermost row of pixel units in each display area 11 is the first row of pixel units, the lowermost row of pixel units is the last row of pixel units; similarly, when the manner of scanning from bottom to top is used, the lowermost row of pixel units in each display area 11 is the first row of pixel units, the uppermost row of pixel units is the last row of pixel units. As shown in FIG. 2, the display device provided by another embodiment of the present invention is implemented in the following way: the display panel 1 can be divided into a Chinese character "Tian" shape, thus in this case the display device may comprise four display areas 11 and four gate driving circuits 12-1, 12-2, 12-3, 12-4. The display device may further comprise two data driving circuits (not shown in the figure) for providing data pulse signals to the display panel 1 in column direction to drive gray scale display of the display panel 1. The whole display area of the display panel 1 may be divided into two image areas, wherein each image area may be driven by a data driving circuit so as to realize bilateral driving in column direction. As shown in FIG. 2, the two display areas 11 at the upper part of the display panel 1 may constitute an image area and be driven by the driving signal of the same data driving circuit, the two display areas 11 at the lower part may constitute an image area and be driven by the driving signal of the same data driving circuit. Certainly, the present application may be applied to a bilateral driven display device in column direction, but not limited to the bilateral driven display device in column direction.

Further, the backlight module 2 may further comprise a backlight driving module 22, the backlight driving module 22 may be used for generating a backlight driving signal and outputting the backlight driving signal to the light emitting unit 21, so as to turn on or off the light emitting unit 21 based on the backlight driving signal. Wherein the backlight driving module 22 may be a circuit with the signal generating function such as a programmable microcontroller or a processor, etc; wherein the backlight driving module 22 and the gate driving circuits 12-1, 12-2, 12-3, 12-4 can be both realized by using a timer control register (Tcon) circuit, i.e., the timing outputs of the backlight driving signal and the scanning signal can be carried out simultaneously by way of a Tcon circuit module.

Figure 3:
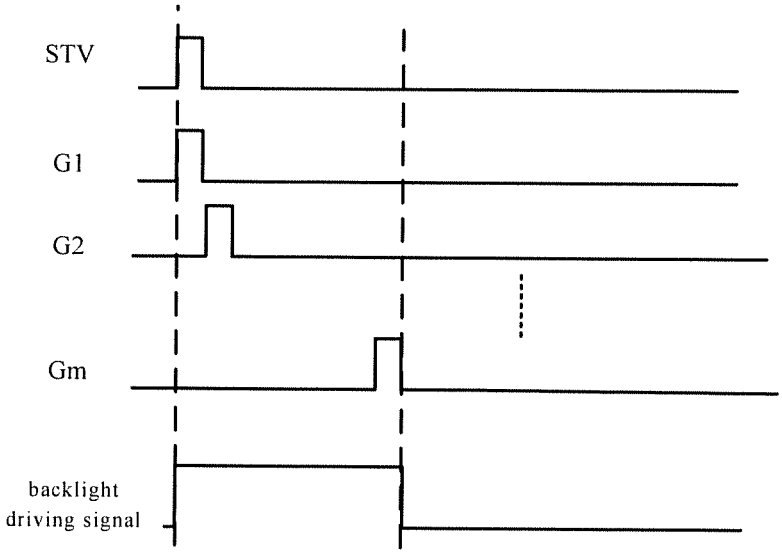
FIG. 3 is a schematic diagram of timing of a backlight driving signal provided by a further embodiment of the present invention.

Further, referring to FIG. 2, the backlight driving module 22 may comprise a signal acquisition sub module 221 and a driving sub module 222, wherein the signal acquisition sub module 221 may be used for acquiring scanning signals of the gate driving circuits 12-1, 12-2, 12-3, 12-4, the driving sub module 222 may be used for generating a backlight driving signal based on the scanning signals of the gate driving circuits 12-1, 12-2, 12-3, 12-4. Here, the backlight driving signal of each light emitting unit 21 is in synchronization with the scanning signal of the corresponding sub display area 111. Referring to FIG. 3, it shows a timing diagram of synchronization of the backlight driving signal of the light emitting unit 21 and the scanning signal of the sub display area 111, FIG. 3 sequentially provides timing signals G1-Gm of the scanning signals of each row of pixel units in a sub display area 111 and the timing of the backlight driving signal, wherein the STV is a frame start signal.

Figure 4:
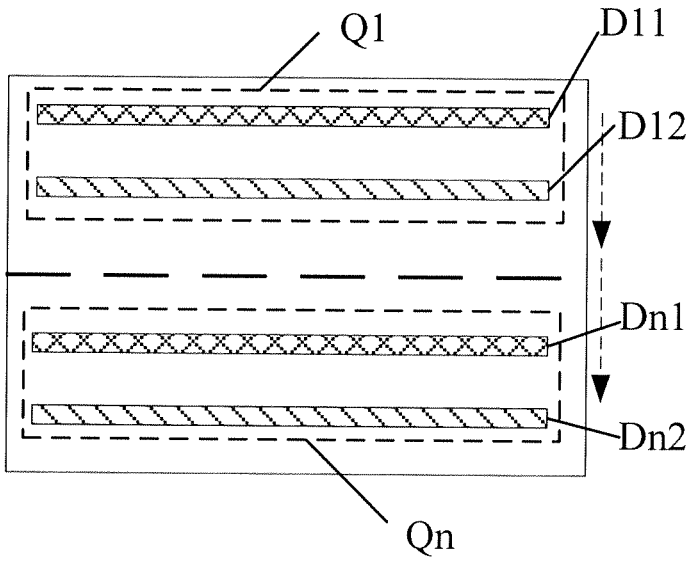
FIG. 4 is a structural schematic view of the distribution of light emitting units of a backlight module provided by another embodiment of the present invention.

FIG. 4 is a structural schematic view of distribution of the light emitting units of a backlight module provided by another embodiment of the present invention, wherein the backlight module as shown in FIG. 4 may comprise the light emitting units of a display panel provided by preceding embodiments of the present invention. Specifically, taking a direct type backlight (1D dimming) as an example, the backlight module provided by the embodiment of the present invention may at least comprise light emitting units D11-Dn2, wherein the dashed block represents display areas Q1-Qn comprised by the display panel to which the backlight module corresponds, wherein each display area may comprise two sub display areas, each of the light emitting unit D11-Dn2 may correspond to a sub display area, wherein each of the display areas Q1-Qn may be controlled by an independent gate driving circuit. FIG. 4 further shows that the backlight module may comprise a column of lamp strips used as the light emitting units, FIG. 4 shows the case of 1D dimming where only one column of lamp strips are included, each of the display areas Q1-Qn may correspond to two rows of lamp strips, for example, the display area Q1 may correspond to lamp strip D11 and lamp strip D12, the display area Qn may correspond to lamp strip Dn1 and lamp strip Dn2.

Figure 5:
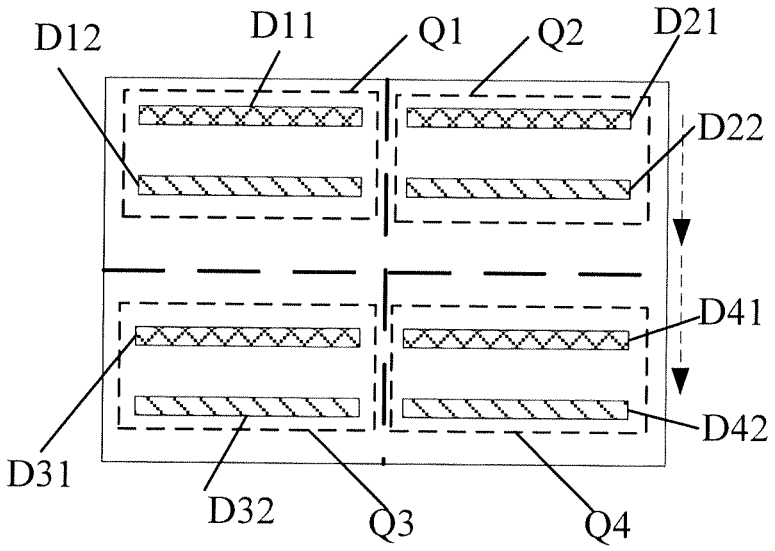
FIG. 5 is a structural schematic view of the distribution of light emitting units of a backlight module provided by yet another embodiment of the present invention.

In addition, it can be understood that the sub display area stated above may be any sub display area other than the last sub display area of the display panel controlled by the scanning signal in column direction. Another embodiment of the distribution of the light emitting units of the backlight module may refer to FIG. 5. The display panel may be divided into four display areas Q1, Q2, Q3, Q4 in a Chinese character "Tian" shape, wherein the display area Q1 may comprise two sub display areas corresponding to lamp strips D11 and D12 respectively, the display area Q2 may comprise two sub display areas corresponding to lamp strips D21 and D22 respectively, the display area Q3 may comprise two sub display areas corresponding to lamp strips D31 and D32 respectively, the display area Q4 may comprise two sub display areas corresponding to lamp strips D41 and D42 respectively. Wherein each light emitting unit may be constituted by a lamp strip, each lamp strip may provide back light for a sub display area correspondingly. The four display areas Q1, Q2, Q3, Q4 may be divided into two columns, in the column direction, the display area Q3 and the display area Q4 are both display areas where the last sub display area controlled by the scanning signal locates. Since the last row of pixel units of the display area Q3 and the display area Q4 may be pixels at the edge of the device, even if bright line occurs, the image quality will not be influenced greatly. Therefore, the sub display areas in the above embodiments may be any sub display area other than the last sub display area of the display panel controlled by the scanning signal in column direction.

In the prior art, since the pixel rows of respective display areas of the display panel are turned on and charged row by row, the potential of the pixel electrode after the charging will be held for a period of time of one frame. In addition, the backlight driving signal is in synchronization with the data line signal in the prior art, the backlight module remains in a bright state in the period of time of one frame. Hence, in each display area where the direction of the scanning signals is in the column direction, after the pixel row in a display area adjacent to the next display area is charged, the backlight module will emit light continuously within the period of time of one frame when the potential of the pixel electrode is held, therefore, after the scanning of a frame is finished, and when the scanning of a next frame just starts from the first row, a bright line may appear in the last row of the previous frame scanning. However, in the embodiments of the present invention, in the case stated above, since when the switch elements of the last row of pixel units scanned during the time of the previous frame are in a turn-off state, the light emitting units in the backlight module corresponding to the display area are also in a turn-off state, thereby avoiding occurrence of bright lines.

The display device provided by the embodiments of the present invention can realize that when the switch elements in the last row of pixel units in a sub display area are turned off, the light emitting unit in the backlight module corresponding to the sub display area is in a turn-off state, so as to avoid occurrence of bad bright line of the image and improve display quality of the image.

Figure 6:
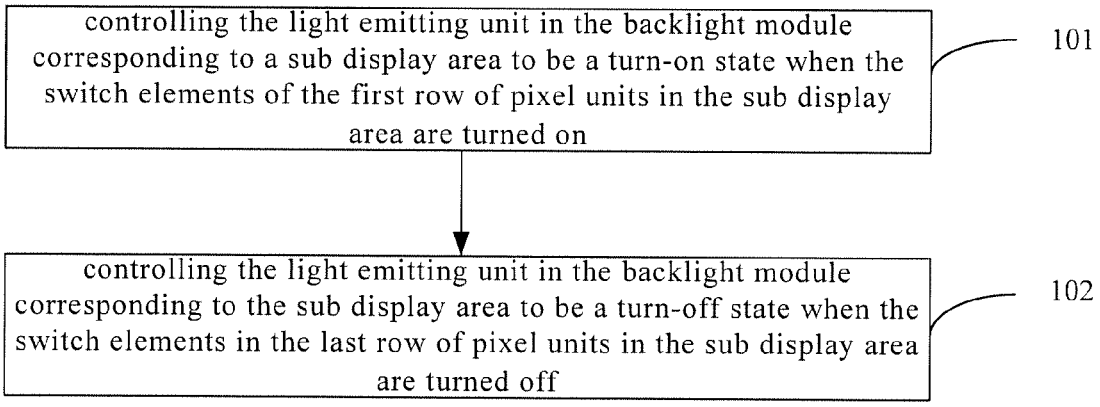
FIG. 6 is a schematic view of flow of a driving method of a display device provided by a further embodiment of the present invention.

Another embodiment of the present invention provides a driving method of a display device, the driving method may be applied to the display devices mentioned above. The display device may comprise a display panel and a backlight module deposed below the display panel; the display panel may comprise at least one display area including at least one sub display area; the backlight module may comprise at least one light emitting unit which may be in one-to-one correspondence with the sub display area; each sub display area may comprise at least one row of pixel units including switch elements. Referring to FIG. 6, the driving method may comprise:

101, controlling a light emitting unit in the backlight module corresponding to a sub display area to be a turn-on state when the switch elements of the first row of pixel units in the sub display area are turned on;

102, controlling the light emitting unit in the backlight module corresponding to the sub display area to be a turn-off state when the switch elements in the last row of pixel units in the sub display area are turned off.

Wherein the order of the steps 101 and 102 is not defined, which can be exchanged based on the turn-on or off state of the switch elements of the last row of pixel units.

In another embodiment, the driving method may further comprise: controlling the switch elements of the pixel units in the display area to be turned on row by row by means of scanning signals.

In another embodiment, the display device may comprise four display areas and four gate driving circuits, the driving method may further comprise: providing a scanning signal to a display area by each gate driving circuit correspondingly. For example, as shown in FIG. 2, the gate driving circuits 12-1, 12-2, 12-3, 12-4 may control the four display areas 11 of the display device respectively, and output scanning signals to the four display areas 11 respectively.

The scanning directions of the scanning signals may be either from top to bottom or from bottom to top, which will not be defined here. However, their scanning directions may be same, i.e., they may all be from top to bottom or from bottom to top.

Further, the driving method may further comprise: generating a backlight driving signal; outputting the backlight driving signal to the light emitting unit so as to turn on or off the light emitting unit based on the backlight driving signal. The step of generating a backlight driving signal may comprise acquiring the scanning signal, and generating the backlight driving signal based on the scanning signal.

The driving method of a display device provided by the embodiments of the present invention can realize that when the switch elements in the last row of pixel units in a sub display area are turned off, the light emitting unit in the backlight module corresponding to the sub display area is in a turn-off state, so as to avoid occurrence of bad bright line of the image and improve display quality of the image.

What is stated above are only embodiments of the present invention, however, the scope of the present invention is not limited to this, any skilled person familiar with the technology in the art can easily think of modifications or alternatives of the embodiments within the technical scope disclosed by this disclosure, these modifications or alternatives should be encompassed within the scope of the present invention. Therefore, the scope of the present invention should be based on that of the attached claims.

The invention claimed is:

1. A display device comprising:

a display panel; and a backlight module disposed below the display panel;

wherein the display panel comprises at least one display area including at least one sub display area, the backlight module comprises at least one light emitting unit which is in one-to-one correspondence with the sub display area, each sub display area comprises at least one row of pixel units including switch elements;

when the switch elements of the first row of pixel units in the sub display area are turned on, the light emitting unit in the backlight module corresponding to the sub display area is in a turn-on state, when the switch elements of the last row of pixel units in the sub display area are turned off, the light emitting unit in the backlight module corresponding to the sub display area is in a turn-off state, wherein the display device further comprises gate driving circuits in one-to-one correspondence with each display area, the gate driving circuits control the switch elements of the pixel units in the display area to be turned on row by row by means of scanning signals, wherein the backlight module comprises a backlight driving module for generating a backlight driving signal and outputting the backlight driving signal to the light emitting unit, so as to turn on or off the light emitting unit based on the backlight driving signal, and wherein the backlight driving module further comprises a signal acquisition sub module and a driving sub module, wherein the signal acquisition sub module is used for acquiring the scanning signals of the gate driving circuit, the driving sub module is used for generating the backlight driving signal based on the scanning signals of the gate driving circuit.

2. The display device according to claim 1, wherein the scanning directions of the scanning signals of the gate driving circuits in one-to-one correspondence with each display area are same.

3. The display device according to claim 1, wherein the number of the at least one display area is four, the number of the gate driving circuit is four.

4. The display device according to claim 3, wherein the display device further comprises two data driving circuits, the four display areas of the display panel constitute two image areas, wherein each image area is driven by one of the data driving circuits.

5. A driving method of a display device, wherein the display device comprises a display panel and a backlight module disposed below the display panel, the display panel comprises at least one display area including at least one sub display area, the backlight module comprises at least one light emitting unit which is in one-to-one correspondence with the sub display area, each sub display area comprises at least one row of pixel units including switch elements;

the driving method comprising:

controlling the light emitting unit in the backlight module corresponding to the sub display area to be a turn-on state when the switch elements of the first row of pixel units in the sub display area are turned on;

controlling the light emitting unit in the backlight module corresponding to the sub display area to be a turn-off state when the switch elements in the last row of pixel units in the sub display area are turned off, wherein the driving method further comprises: controlling the switch elements of the pixel units in the display area to be turned on row by row by means of scanning signals, wherein the driving method further comprises:

generating a backlight driving signal;

outputting the backlight driving signal to the light emitting unit so as to turn on or off the light emitting unit based on the backlight driving signal, and wherein the step of generating a backlight driving signal comprises: acquiring the scanning signals, and generating the backlight driving signal based on the scanning signals.

6. The driving method according to claim 5, wherein the display device further comprises four gate driving circuits, the number of the at least one display area is four, the driving method further comprises: providing the scanning signals to each of the four display areas by each of the four gate driving circuits in one-to-one correspondence with the four display areas respectively.

7. The driving method according to claim 6, wherein the scanning directions of the scanning signals outputted by the four gate driving circuits are same.

* * * * *